United States Patent [19]

Simjian

[11] Patent Number: 4,494,757

[45] Date of Patent: Jan. 22, 1985

[54] GOLF PUTTING DEVICE

[75] Inventor: Luther G. Simjian, Fort Lauderdale, Fla.

[73] Assignee: Command Automation, Inc., Greenwich, Conn.

[21] Appl. No.: 525,012

[22] Filed: Aug. 22, 1983

[51] Int. Cl.[3] ..... A63B 69/36

[52] U.S. Cl. ..... 273/183 C; 273/DIG. 20

[58] Field of Search ..... 273/183 C, 199, DIG. 20, 273/58 A, 58 K, 200 R, 200 B

[56] References Cited

U.S. PATENT DOCUMENTS 3,796,435 3/1974 Dale ..... 273/183 C 4,278,254 7/1981 Simjian ..... 273/183 C

*Primary Examiner*—George J. Marlo

[57] ABSTRACT

A golf putting aid comprises a plastic molded body exhibiting a set of spaced wheels and a sighting device in the form of a simulated golf ball mounted to and between the wheels. The spacing between the wheels is such that the wheels can be stroked simultaneously by a putter, in which case the aid is propelled along a straight path. If not addressed correctly, the aid is propelled along a curved path, the curvature being indicative of the degree of incorrect putting. Weight members in the form of metal washers are provided on each wheel in order to improve the rolling characteristic of the golf putting aid.

1 Claim, 1 Drawing Figure

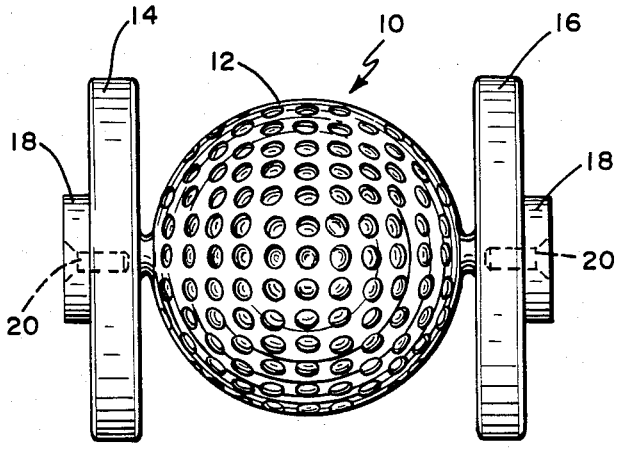
14
10
16
12
18
18
20
20

GOLF PUTTING DEVICE

SUMMARY OF THE INVENTION

This invention relates to golf training devices and, more particularly, concerns a device for improving the putting of a golf player. Quite specifically, this invention relates to improvements in the golf putting aid disclosed in U.S. Pat. No. 4,278,254 issued to me on July 14, 1981 and entitled, "Golf Putting Device".

As is well known to golfers, putting is a most important aspect of a game and in many instances is decisive whether a match is won or lost. Hence, great effort is made, even by professional players, to improve the skill of putting.

In the patent described above, a putting aid is described which greatly aids in the development of a proper stance, proper gripping of the putter and proper stroking of a golf ball to propel the ball to the cup or to a marked spot on a training surface.

To this end, my earlier patent shows a putting device in the form of a set of spaced wheels with a sighting device in the shape of an actual or simulated golf ball disposed therebetween. As the golfer views the sighting device, he strokes the device thereby contacting the wheels and causing the device to be propelled forward. If both wheels are stroked simultaneously, the device will be propelled forward in a straight line. If stroked incorrectly, the device will execute a curved path. The degree of curvature indicates the degree of skill or lack thereof on the part of the golfer.

The present invention concerns an improvement made to the heretofore disclosed golf putting aid when the aid is constructed from plastic material as a unitary device, as by plastic injection molding.

One of the principal objects of this invention is the provision of an improved golf putting aid.

Another principal and important object of this invention is the provision of a golf putting aid as disclosed in the above stated patent, providing improved rolling characteristics.

Further and still other objects of this invention will become more clearly apparent by reference to the accompanying FIGURE when viewed in conjunction with the description.

BRIEF DESCRIPTION OF THE FIGURE

The single FIGURE is a top plan view of my improved golf putting aid.

DETAILED DESCRIPTION OF THE INVENTION

Referring now to the FIGURE, numeral 10 identifies the golf putting aid made by molding thermoplastic material to provide a unitary body. Numeral 12 identifies a sighting device in the form of a simulated golf ball which may be of the same size as a regulation golf ball or be slightly smaller. There are shown also two wheels 14 and 16 for propelling the putting aid 10. The distance between the wheels 14, 16 is such that a putter, when stroking the golf putting aid, will contact both wheels simultaneously. The crown diameter of the wheels is slightly greater than the diameter of the simulated ball 12 to cause rolling contact between the wheels and the underlying surface when the putting aid is stroked by a putter.

When the putter strokes the putting aid correctly, that is both wheels are contacted simultaneously, the aid will roll forward along a straight line. If the aid is stroked with an angled putter, the putting aid will roll forward along a curved path. The curvature indicates the degree of corrective action necessary by the golfer.

When the putting aid as shown hereinabove was molded from plastic material as a unitary body, it was found that the aid lacked the proper feel and rolling characteristic as is experienced with regular golf balls when stroked with a putter. Investigation showed that it was necessary to add weight means to the aid. A metal pin mounted through the center did not impart the desired characteristic. After further experimentation it was established that weight means in the form of disk shaped metal washers 18, one mounted to the outer surface of each of the wheels will provide the proper characteristic. As shown, each washer is secured to the outer radial surface of a respective wheel by a self tapping screw 20. It is important, of course, that the washers 18 and the sighting device 12 be concentric with the wheels in order to provide a balanced assembly rotating without wobble. Subsequent extensive use of the golf putting aid has proven that this construction forms a most valuable putting aid. For appearance sake, the washer and screw assembly most suitably may be covered by a decorative adhesive label.

What is claimed is:

1. A golf putting aid made of plastic material including a pair of concentrically rotating wheels spaced from each other by a distance for being stroked by a putter, a sighting device resembling a golf ball concentrically mounted between said wheels, the diameter of said wheels being slightly greater than that of said ball for causing said ball to be free of rolling contact with an underlying surface upon which said wheels roll when stroked, the improvement comprising: said aid being a unitary molded plastic body, and weight means in the form of a respective disk shaped metal washer fastened concentrically upon the outer radial surface of each wheel for increasing the weight of said body to thereby cause said aid to more closely exhibit the rolling characteristic of a regular golf ball.

* * * * *